US005855048A

United States Patent [19]

Synowicki et al.

[11] Patent Number: 5,855,048

[45] Date of Patent: Jan. 5, 1999

[54] JEWELER'S STONE SETTING TOOL

[76] Inventors: Robert R. Synowicki, 6838 E. Eagle Crest Dr., Flagstaff, Ariz. 86004; Walter Synowicki, 2019 W. Lodi Ave., Lodi, Calif. 95242

[21] Appl. No.: 895,699

[22] Filed: Jul. 17, 1997

[51] Int. Cl.[6] ..... B23P 5/00

[52] U.S. Cl. ..... 29/10; 81/424.5; 81/426.5

[58] Field of Search ..... 29/10, 896.41, 29/896.411, 896.412; 63/26, 27; 81/7, 418, 424.5, 426, 426.5

[56] References Cited

U.S. PATENT DOCUMENTS

| | | | |
|---|---|---|---|
| 851,906 | 4/1907 | Strassburger | 81/426 |
| 933,749 | 9/1909 | Feagle | 29/10 |
| 1,045,299 | 11/1912 | Krimmling | 29/10 |
| 1,546,814 | 7/1925 | Toy . | |
| 1,757,120 | 5/1930 | Helfgott . | |
| 2,157,789 | 5/1939 | Hudgens et al. | 29/10 |
| 3,333,321 | 8/1967 | Williams | 29/401 |
| 3,401,444 | 9/1968 | Kovacs | 81/426 |
| 3,435,513 | 4/1969 | Knittweis | 29/567 |
| 5,188,679 | 2/1993 | Kretchmer | 148/538 |
| 5,285,659 | 2/1994 | Bardisbanyan | 63/26 |
| 5,339,655 | 8/1994 | Grando | 63/3 |

*Primary Examiner*—P. W. Echols
*Attorney, Agent, or Firm*—Antonio R. Durando

[57] ABSTRACT

A tool for setting a gemstone on a jewel's head has a pair of jaws which are pivotally connected to one another. The tip of each jaw comprises a substantially longitudinal ridge protruding inward along the center of the tip, and a substantially longitudinal groove or channel aligned with the main axis of the jaw. Due to the identical configuration of both jaws, when the jaws are in closed position, the corresponding ridges and grooves define a partially enclosed space substantially conforming to the shape of a conventional solitaire head with a post, thereby providing a clamping geometry that allows a firm grip on the solitaire head.

14 Claims, 4 Drawing Sheets

JEWELER'S STONE SETTING TOOL

BACKGROUND OF THE INVENTION

1. Field of the Invention

The invention relates to a tool for setting a gemstone on a jewel's head; in particular, it concerns a tool for mounting a solitaire stone in the head of a ring or earring.

2. Description of the Prior Art

The art of mounting gemstones on rings, earrings, bracelets, necklaces and pendants is ancient. In so doing, it is always important to minimize the points of contact between the stone and the carrying structure while producing a secure grip on the stone, so as to enhance the visibility of the ornament while ensuring its safety. Accordingly, different approaches have been followed to securely fasten the gemstone to the piece of jewelry to which it is mounted, ranging from clasping the stone with metallic clamps to attaching it by means of an adhesive.

The task requires handling two generally small structures, the stone on one hand and the setting head on the other hand, and attaching one to the other with minimal contact and stress being imposed on the gem or the head in order to avoid damage to either component. In the case of solitaires, the stone is typically mounted on a setting head with multiple prongs that are rigidly clamped around the stone. As illustrated in FIG. 1 for an earring, a round setting head 10 is first prepared by a seat forming, burring tool 12 that is lowered into the head to machine it and provide a seat conforming to the shape and size of the stone. The gem is then lowered into the seat portion 20 of the head and the prongs 14 are clamped around the gem to secure it in place. Thus, the two components must be handled firmly and with precision during the mounting process. Earring heads include a post 16 for connection with a clasp 18. Other heads are attached by solder or otherwise to the intended support structure (such as a ring, pendant, etc.).

As one skilled in the art would know, the head shown in FIG. 1 is normally referred to as a round head and consists of a rounded body that may have an open base or a closed base with a post, as seen in the figure. The prongs 14, typically four or six, are integral with the body of the head. Another type of head 10', referred to as a solitaire head, is shown in FIG. 1A. In this head embodiment, which can also be with or without post, the prongs 14 (again typically four or six, as seen in the figure) are individual structures converging to a lower support post 19 and an upper seat portion 20' defined by the inner surfaces of the prongs. In the solitaire-head embodiment 10' each pair of prongs 14 forms a recess 21 running from the seat portion 20' to the support peg 19.

Typically, jewelers hold the head 10 (with or without the post 16) with a tool that permits the burring operation and the subsequent attachment of the stone to the head by bending the prongs 14 around it. U.S. Pat. No. 1,546,814, No. 1,757,120, No. 2,157,789, No. 3,333,321, No. 3,435,513, No. 5,188,679, No. 5,285,659 and No. 5,339,655 describe various machines for carrying out the necessary steps and facilitating the process of holding the head firmly while mounting the stone to it. None of them provides a simple tool that makes it possible for a jeweler to simply hold the head firmly and steadily with one hand while operating on it with the other. This invention is directed to providing such a tool.

BRIEF SUMMARY OF THE INVENTION

It is an object of the invention to provide a tool capable of holding a conventional multi-prong stone-setting head firmly for facilitating the process of mounting a gemstone on the head.

It is also a goal of the invention to provide a tool suitable for holding the setting head firmly with a single hand, thereby enabling the use of the other hand for performing work on the head.

Another object of the invention is to provide a set of tools with common functional characteristics for holding various multi-prong heads regardless of the number of prongs and the specific structure of each prong.

Still another object of the invention is to provide a set of tools with common functional characteristics for holding various multi-prong heads regardless of whether or not they include a post.

An additional object of the invention is to provide a tool which is suitable for rigidly and firmly holding a setting head during a burring step and a gemstone mounting step without damaging either the head or the stone.

Finally, a goal of the invention is to provide a tool or tools to achieve these objectives inexpensively by modifying the jaws of existing pliers to produce the intended results.

The preceding objects, as well as others which will become apparent as the description proceeds, are achieved by the invention.

One aspect of the invention resides in a hand-held gemstone setting tool designed primarily for multi-prong solitaire heads, with or without a post. The tool comprises a first member having a first holding element or jaw, and a second member having a second holding element or jaw. The holding elements are coupled in swiveled arrangement so as to be movable between an open position in which the holding elements are spaced from one another and a closed position in which the holding elements contact each other at least in part. Proceeding downward from the tip of the jaw for the purpose of description, the tip portion of each jaw is provided with a substantially longitudinal ridge protruding inward along the center of the tip, followed by a substantially longitudinal semicylindrical groove or channel aligned with the axis of the tool. Due to the identical configuration of both holding elements, when in closed position they are in contact with each other with the exception of the areas corresponding to the ridge and groove, which together define a partially enclosed space substantially conforming to the shape of a conventional solitaire stone head with a post. With reference to the head illustrated in FIG. 1, the post 16 fits within the substantially cylindrical space defined by the grooves in the two jaws, and two recesses 21 between pairs of prongs 14' on opposite sides of the head fit around the ridges, which in closed position provide a clamping structure that allows a firm grip on the gemstone head. This embodiment provides a tool able to clamp any solitaire head with multiple prongs, no matter how many, so long as they are uniformly spaced around the head with an opening between prongs sufficient to allow penetration of the tool's two ridges. Common gemstone heads are available with four or six prongs.

Another aspect of the invention resides in a more specific embodiment of a hand-held gemstone setting tool designed for a four-prong round head (seen in FIG. 1). As in the case of the first embodiment, the tool comprises a first member having a first holding element or jaw and a second member having a second holding element or jaw. The jaws are hinged to one another and movable between an open position in which they are spaced from one another and a closed position in which they are at least in part in contact with one another. Each jaw consists of a structure having an inner flat surface partially carved out to form the features of the invention. The flat surfaces of the jaws are substantially normal to the plane of motion of the first and second members as they move from an open to a closed position and vice versa; and, when the tool is in closed position, the flat surfaces are disposed substantially radially with respect to the swivel point. Again proceeding downward from the tip of the jaws for the purpose of description, the inner surface at the tip of each jaw is shaped by etching two longitudinal channels adjacent the main axis of the jaw, thereby producing a substantially longitudinal inner ridge protruding inward along the center of the tip and two symmetric outer ridges derived from the outer edges of the tip portion of the jaw; a transverse semicircular notch defining an approximately semicylindrical surface coaxial with the longitudinal axis of the tool follows the ridge area; and a substantially longitudinal groove or channel aligned with the main axes of the semicircular notch and the tool completes the structural geometry of the tool. Again, due to the identical configuration of both jaws, their inner surfaces become in contact with each other when in closed position, with the exception of the areas corresponding to the ridges, notches and grooves, which together define a partially enclosed space substantially conforming to the shape of a conventional round four-prong setting for a stone with a post. The post 16 fits within the substantially cylindrical space defined by the grooves, the seat portion 20 fits within the substantially cylindrical space defined by the notches, and the four prongs 14 of the head fit snugly between the ridges, which close around the seat portion and thereby provide a clamping structure, specific to round four-prong settings, that allows a firm grip on it for setting the gemstone.

By virtue of the fact that the jaws of the tool are designed to make contact with one another in the closed position, except for the areas just described, the action of the tool on a conforming head is quite gentle. Accordingly, the surface of the head material undergoes no damage so long as the appropriate tool size is used. Obviously, the size of the tool must conform substantially to the size of the heads for which it is intended, as one skilled in the art would understand.

By applying the tools of the invention to a gemstone head and manipulating the tool in closed position while holding the head, a device is provided for handling the head firmly and with dexterity during the burring operation and the gemstone setting process. Afterwards, the stone-head assembly is ready for attachment to the supporting structure, a ring, earring or the like.

Various other purposes and advantages of the invention will become clear from its description in the detailed specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS

The heart of this invention lies in the recognition that all multi-prong gemstone heads share structural features that make it possible to design a holding tool capable of clamping the head firmly and improve the ease and dexterity with which it is handled during the stone setting process. The opening between prongs and the shapes of the seat portion and of the post in the head provide a structure suitable for clamping the head in a pincers-type tool.

Figure 2:
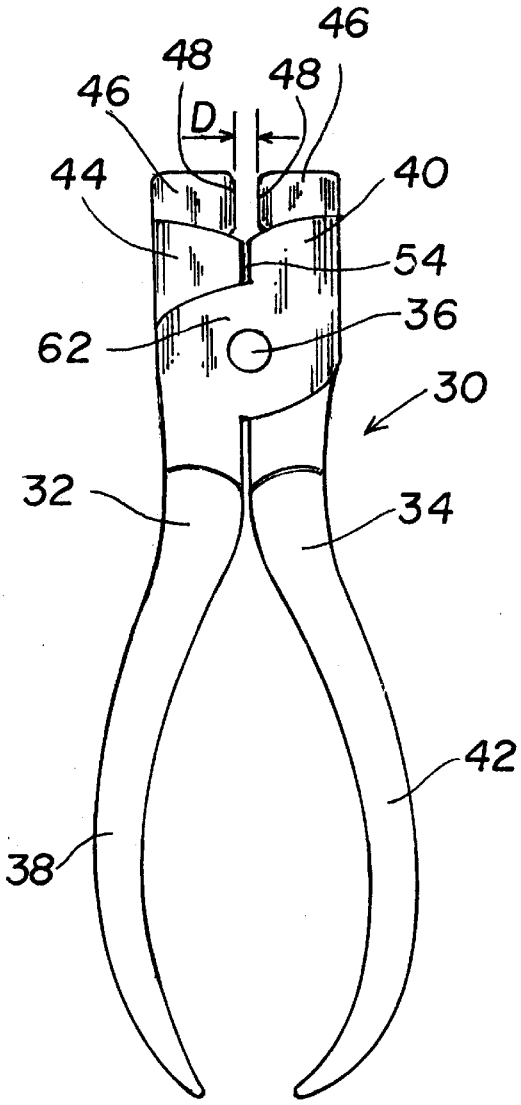
FIG. 2 is an elevational side view of a stone setting tool according to the preferred embodiment of the invention.

Referring to the drawings, wherein like parts are designated throughout with like numerals and symbols, FIG. 2 is an elevational view of a stone setting tool according to the first embodiment of the invention identified generally by the reference numeral 30. The tool 30 has two members 32 and 34 which constitute two-armed levers in closed position and are arranged so that the tool 30 resembles pliers. Thus, the members 32 and 34 are pivotally connected to one another by a pivot 36 located between the ends of the members 32 and 34. One arm of the member 32 constitutes a handle 38 of the tool while the other arm constitutes a jaw 40. Similarly, one arm of the member 34 constitutes a handle 42, whereas the second arm constitutes a jaw 44.

Figure 3:
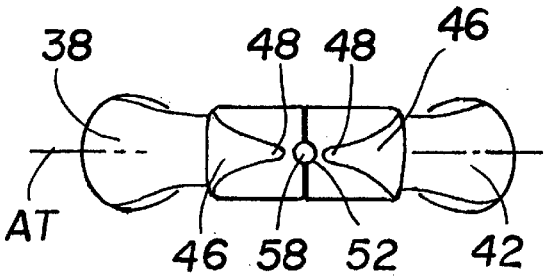
FIG. 3 is a top view of the tool seen in FIG. 2.

The jaws 40,44 have a substantially identical shape designed to provide a structure adapted to conform to the shape of a solitaire head 10' (see FIG. 1A) to be clamped for setting a stone thereon. As seen in the top view of FIG. 3, each jaw 40,44 comprises a top portion 46 that includes a ridge 48 projecting inwards substantially along the transverse axis AT of the tool. As illustrated also in FIG. 4, which is a front elevational view of a single member 32, the ridge 48 is substantially parallel to the longitudinal axis AL of the tool 30. The two ridges 48 constitute retaining means that fit in the recesses 21 between pairs of prongs 14' when the solitaire head 10' is clamped in the tool 30. Accordingly, the inner portion (longitudinal tip) of the ridge 48 cannot be wider than the gap between prongs in the head intended for use. A pointed geometry forming an angle of 35–40 degrees has been found to provide a structure that fits all multi-prong solitaire heads that are commensurate with the size of the tool.

For clarity and definiteness of description, the longitudinal or main axis of the tool is defined as its longitudinal axis when the tool is in closed position; the longitudinal or main axis of each jaw is defined as that axis thereof that is coextensive with the main axis of the tool in closed position; and the main axis of the approximately semicylindrical surface of the notch of the invention in each jaw is also defined as that axis thereof that is coextensive with the main axis of the tool in closed position.

An intermediate portion 50 of each jaw 40,44 includes a semicircular notch 52 defining an approximately cylindrical surface sized to receive the post 19 of a gemstone solitaire head 10'. The balance of the inner face of the intermediate portion 50 consists of two flat surfaces 54 which act as stoppers by butting against corresponding surfaces in the other jaw when the tool is closed.

Finally, a lower portion 56 of each jaw 40,44 contains a semicylindrical channel or groove 58 having the same crossectional radius of the notch 52 and aligned with it. The channel 58 is provided to receive the lower portion of the post 19 of a solitaire head 10' in cases when the cavity formed by the notches 52 is not deep enough. In the embodiment shown in FIGS. 2–4, the two members 32 and 34 are hinged to one another through a swivel opening 60 bored through a cross member 62 (see FIG. 2) overlapping the two sides of the tool 30. Because the cross-member 62 is only about half as wide as the tool 30, as illustrated particularly in FIG. 5, the groove 58 is rotated essentially 90 degrees with respect to the notch 52, and both of them form complete and aligned circular openings comprising a single bore (see FIG. 3) when the two jaws 40 and 44 are brought together.

Figure 6:
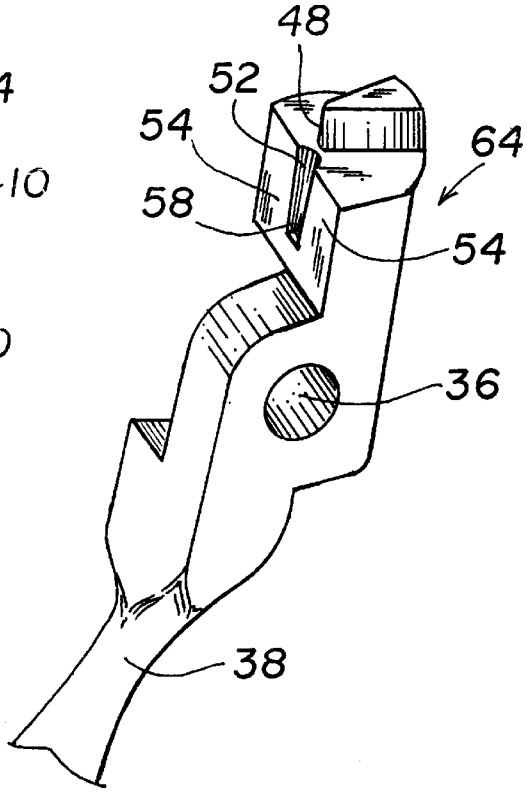
FIG. 6 is a perspective view of one of the members constituting the two-armed levers of the tool of FIG. 2 illustrating the ridge, notch and groove features of the invention.

The essence of this embodiment of the invention is the combination of a ridge 48, a semicircular notch 52 and a semicircular channel 58 in each of two jaws constituting a clamping tool. The particular relative radial disposition of the notch and channel is not important so long as they produce coaxial enclosures upon closure of the jaws. If sufficient space away from the swivel portion is available in the jaw, all three components can be formed with the same orientation, as illustrated in the embodiment 64 shown in partial perspective view in FIG. 6 (note that the notch 52 and groove 54 form a single channel).

Figure 7:
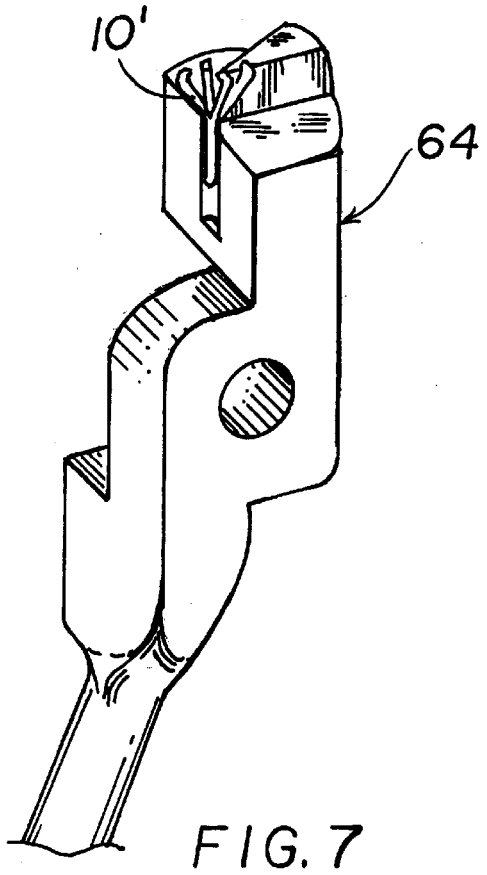
FIG. 7 is the member of FIG. 6 illustrating a gemstone head placed within the ridge, notch and groove of the invention.

In operation, it is clear that the tool 30 can be used to firmly hold a multi-pronged solitaire head 10' by placing its post 19 in the notch 52 and groove 58, if necessary, and the prongs 14' such that the ridge 48 protrudes inwards between two adjacent prongs, as illustrated in FIG. 7. Note that the head in FIG. 7 is shown with a particularly long post 19 to illustrate the fit within the various parts of the invention, but most solitaire heads have a short post or peg. It is apparent that the number of equally spaced prongs on the head is immaterial for a good fit so long as sufficient space is present between them for the ridge 48 to protrude inwards. It is also noted that the tool 30 can be used equivalently for a solitaire head that does not have a post 19 if its general dimensions conform to the size of the tool. In fact, so long as the ridges 48 can clamp the recesses 21 of a head between pairs of prongs 14', the tool 30 can be used for setting a stone. In addition, it is also understood that the same features of the invention can be implemented in equivalent fashion in regular- as well as parallel-plier models.

Once so clamped, a solitaire head 10' can be held with one hand while a burring tool 12 is held with the other hand to form a seat matching the dimensions of the stone to be mounted thereon. Obviously, the protrusion of the ridge 48 into opposite recesses 21 must not be such as to prevent the passing of the burring tool 12 therethrough when the jaws 40,44 are clamped together to hold the head 10'. Therefore, the size and inward extension of the ridge 48 is judiciously selected so that the gap D between the two ridges 48 in closed position is at least as wide as the diameter of the burring tool to be used with the stone head of interest.

Figure 1:
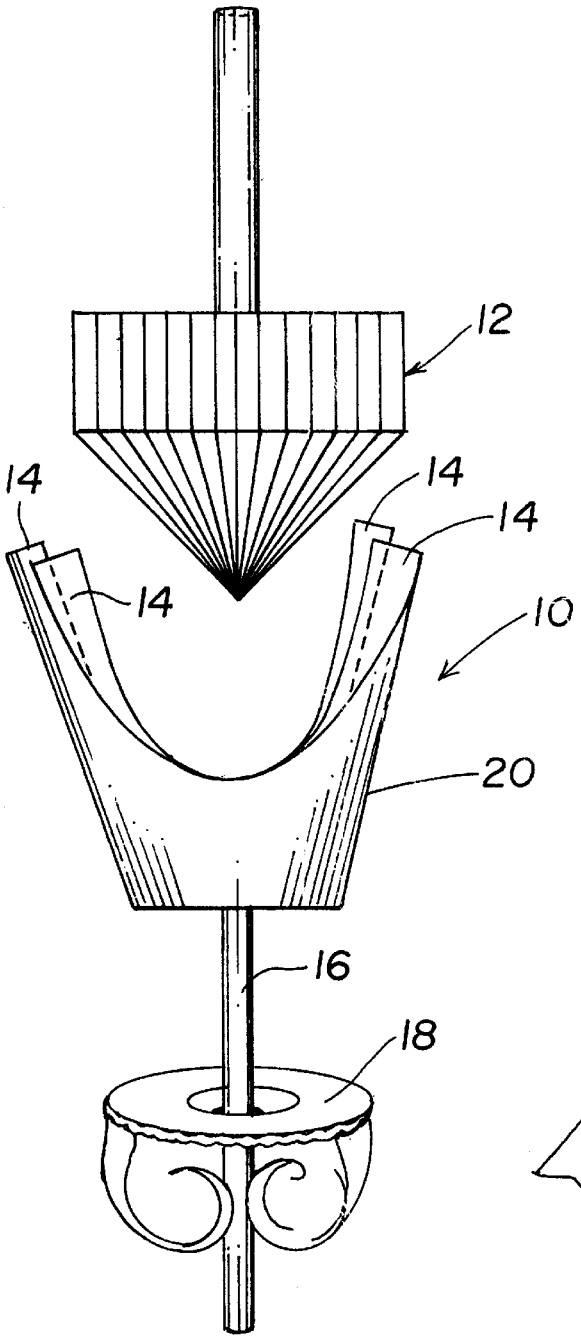
FIG. 1 (PRIOR ART)
FIG. 1 is a perspective view of a four-prong round head for a gemstone, shown with a seat-forming burring tool and a support structure.
Figure 1A:
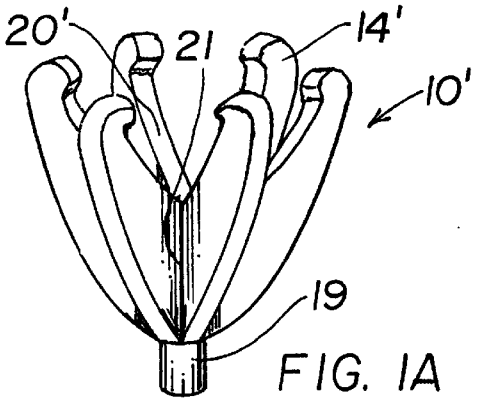
FIG. 1A is a perspective view of a six-prong solitaire head for a gemstone.
Figure 4:
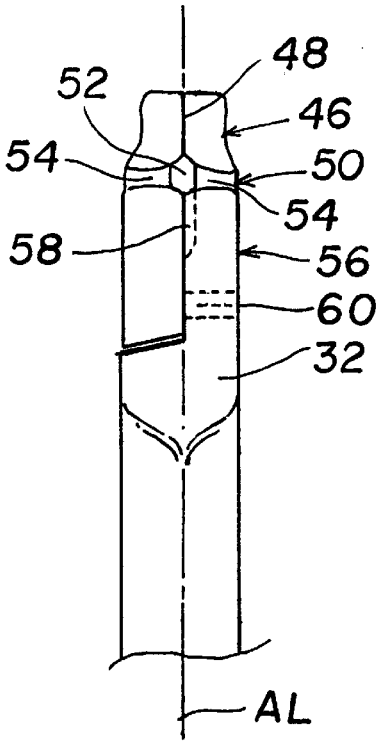
FIG. 4 is an elevational front view of one of the members constituting the two-armed levers of the tool of FIG. 2.
Figure 5:
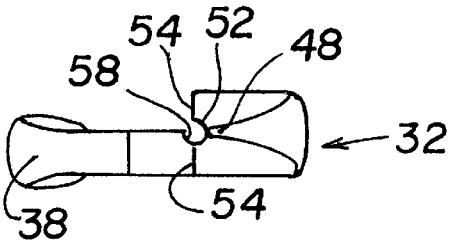
FIG. 5 is a top view of the member shown in FIG. 4.
Figure 8:
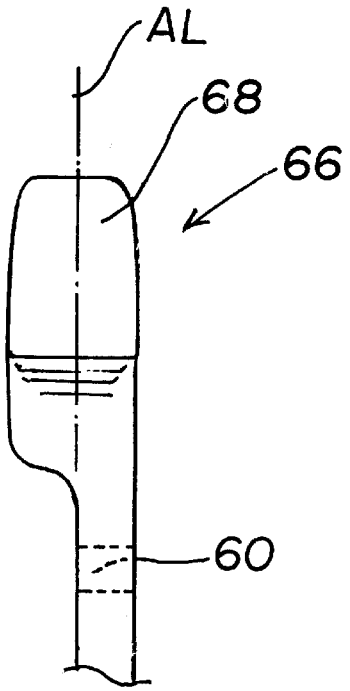
FIG. 8 illustrates the inside of a conventional flat-surfaced pliers jaw as a starting point in making a stone setting tool according to a second embodiment of the invention.
Figure 9:
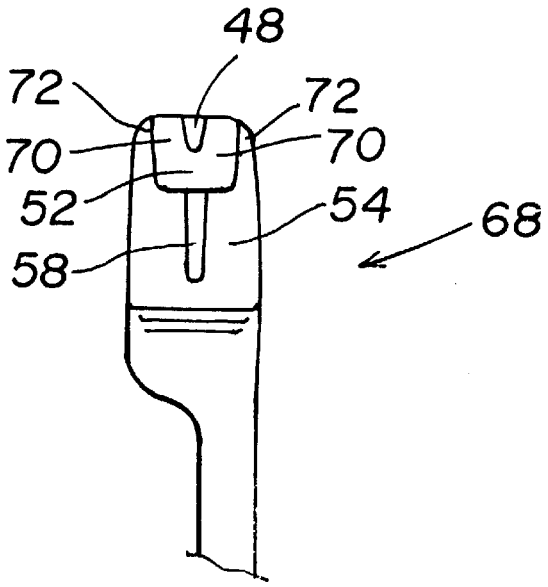
FIG. 9 shows the structural features of the second embodiment of the invention produced by etching the flat-surfaced jaw of FIG. 8.
Figure 10:
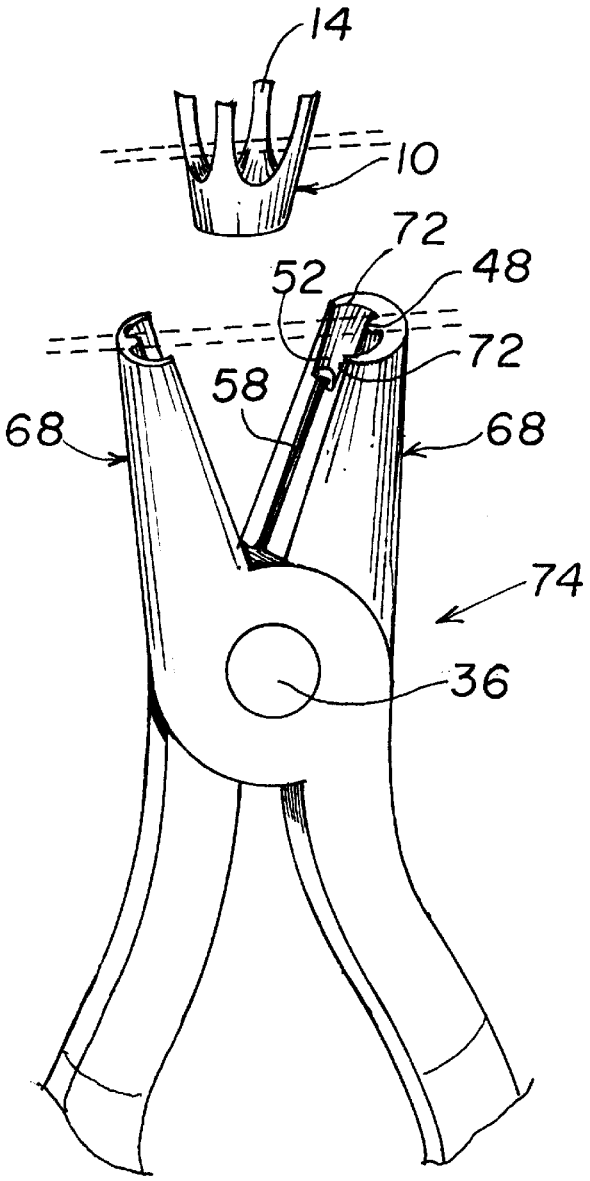
FIG. 10 is a perspective view of a gemstone setting tool according to the embodiment of FIG. 9 illustrating the ridge, notch and groove features of the invention and a stone head for which the tool is intended.
Figure 11:
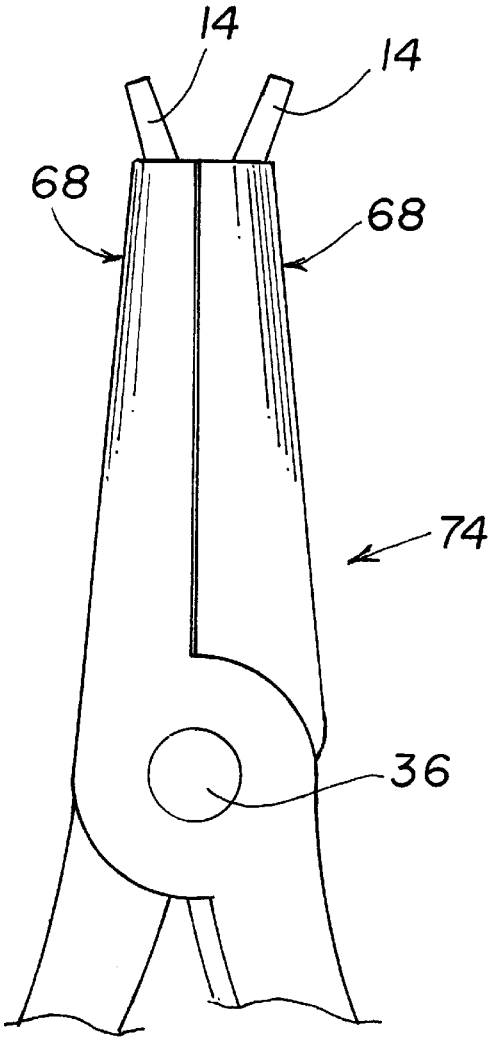
FIG. 11 is the tool of FIG. 9 shown clamping a stone head.

An alternative embodiment of the invention specific to four-prong round heads (FIG. 1) is based on the idea of forming all functional components from a flat surface in the top portion 46 of the jaws, such as is found in jaws of conventional pliers. Referring to FIG. 8, such a typical flat-surfaced pliers jaw 66 is shown to illustrate the starting point in making a stone setting tool according to the invention. The flat surface 68 is etched, through machining or otherwise, as one skilled in the art would know, to form two substantially longitudinal channels 70 adjacent the main axis AL of the jaw, thereby producing a longitudinal inner ridge 48 protruding inward along the center of the tip. As seen in the resulting etched jaw 68 shown in FIG. 9, such ridge is structurally and, depending on the use, possibly also functionally equivalent to the ridge 48 of the embodiment shown in FIGS. 2–7. As a result of the formation of the two channels 70, two symmetric outer ridges 72 are also produced from the edges of the tip portion of the jaw. Continuing downward from the tip of the jaw 66, a substantially transverse semicircular notch 52 is formed to define an approximately semicylindrical surface coaxial with the longitudinal axis of the tool. The surface of the notch 52 may be slightly tapered outward toward the top in the form of a truncated cone surface to conform to the exact shape of the seat portion 20 of most round heads, but we found that a substantially cylindrical shape is suitable to practice the invention, the most critical issue being that the head fit snugly between the jaws when they are clamped together in closed position. Accordingly, the surface of the notch 52 may approximate the geometry of a half donut disposed perpendicularly to and with its center on the axis AL (FIG. 4). Finally, the same longitudinal groove or channel 58 of the first embodiment, coaxially disposed with the semicircular notch 52 and the main axis of the jaw (and of the tool when the jaws are closed), completes the structural geometry of the inventive features of the tool. Due to the identical configuration of both jaws, when the tool is in closed position, the surfaces 54 of both jaws abut against one another and define an enclosure corresponding to the grooves 58, notches 52 and channels 70 substantially conforming to the shape of a conventional four-prong round head with a post, as seen in FIG. 1. Again, in use the post 16 is fitted within the substantially cylindrical space defined by the grooves 58 of both jaws, the seat portion 20 is fitted within the substantially cylindrical space defined by the notches 52, and each of the four prongs 14 of the head is fitted within each channel 70. Thus, the configuration of the invention provides a clamping structure, specific for four-prong round heads, that allows a firm grip on a head for setting a gemstone thereon. FIGS. 10 and 11 illustrate the use of such a tool 74 in standard-pliers form for clamping a four-prong round head.

The invention is described herein in terms of a notch 52 having a substantially semicylindrical surface, but it is understood that the principle and functional characteristics of the invention apply to any geometry of the notch so long as conforming to the shape of the seat portion 20 of the round head 10 for which the tool is designed. Similarly, the invention is described in terms of two embodiments, the first being preferred because of its wider application, each including a groove 58 for receiving the post of the stone head. It is understood, though, that a conforming head without a post could equivalently be clamped and set by the tools of the invention.

Based on current pliers available on the market, it is expected that the tools of the invention will be manufactured in seven sizes corresponding to the dimensions of the gemstones for which they are intended. Size 1 is for 0.01–0.07 carat diamonds (and other stones of equivalent volume); size 2 for 0.08–0.15 carat diamonds; size 3 for 0.16–0.25 carat diamonds; size 4 for 0.26–0.40 carat diamonds; size 5 for 0.41–0.65 carat diamonds; size 6 for 0.65–1.00 carat diamonds; and size 7 larger than 1 carat diamonds.

Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

We claim:

1. A tool for setting a stone on a jewel's head, comprising a first member having a first holding element and a second member having a second holding element; said holding elements being movable between an open position in which said holding elements are spaced from one another and a closed position in which said holding elements contact each other; and wherein each of said holding elements is provided with a substantially longitudinal ridge protruding inward toward the other holding element, and is provided with a substantially semicylindrical groove aligned with said longitudinal axis, such that said groove in each element when the elements are in said closed position define a form conforming substantially with the geometry of said jewel's head.

2. The tool of claim 1, further comprising means for connecting said members to one another for pivotal movement between said positions.

3. The tool of claim 1, further comprising a notch disposed between and aligned with said ridge and said semicylindrical groove, said notch having a substantially semicircular surface defining a space coaxial with a longitudinal axis of the tool when the elements are in said closed position.

4. The tool of claim 3, wherein said substantially semicircular surface of the notch defines an approximately semicylindrical space.

5. The tool of claim 4, further comprising means for connecting said members to one another for pivotal movement between said positions.

6. The tool of claim 3, wherein said substantially semicircular surface of the notch defines an approximately semiconical space.

7. The tool of claim 6, further comprising means for connecting said members to one another for pivotal movement between said positions.

8. The tool of claim 3, further comprising two outer ridges disposed symmetrically and approximately parallel to said substantially longitudinal ridge in each element.

9. The tool of claim 8, wherein said substantially semicircular surface of the notch defines an approximately semicylindrical space.

10. The tool of claim 9, further comprising means for connecting said members to one another for pivotal movement between said positions.

11. The tool of claim 8, wherein said substantially semicircular surface of the notch defines an approximately semiconical space.

12. The tool of claim 11, further comprising means for connecting said members to one another for pivotal movement between said positions.

13. A tool for setting a stone on a jewel's multi-prong solitaire head, comprising a first member having a first holding element and a second member having a second holding element; said holding elements being movable between an open position in which said holding elements are spaced from one another and a closed position in which said holding elements contact each other; comprising means for connecting said members to one another for pivotal movement between said positions; and wherein each of said holding elements is provided with a substantially longitudinal ridge protruding inward toward the other holding element, and is provided with a substantially semicylindrical groove aligned with said longitudinal axis, such that when the elements are in said closed position said grooves define a form conforming substantially with the geometry of a post, and said ridges grip recesses between opposite pairs of prongs in the solitaire head.

14. A tool for setting a stone on a jewel's round head, comprising a first member having a first holding element and a second member having a second holding element; said holding elements being movable between an open position in which said holding elements are spaced from one another and a closed position in which said holding elements contact each other; comprising means for connecting said members to one another for pivotal movement between said positions; and wherein each of said holding elements is provided with a substantially longitudinal ridge protruding inward toward the other holding element, is further provided with two outer ridges disposed symmetrically and approximately parallel to said substantially longitudinal ridge, is provided with a notch having a substantially semicircular surface defining a space coaxial with a longitudinal axis of the tool when the elements are in said closed position, and is provided with a substantially semicylindrical groove aligned with said longitudinal axis, such that said notch and groove in each element when the elements are in said closed position define a form conforming substantially with the geometry of said jewel's round head.

* * * * *